US006854151B2

(12) United States Patent
Wang

(10) Patent No.: US 6,854,151 B2
(45) Date of Patent: Feb. 15, 2005

(54) BRUSH PROVIDED WITH A REPLACEABLE FELT UNIT

(76) Inventor: Huo-Pia Wang, No. 9-2, Alley An-Tou, Yen-Ping Li, Chang-Hua City (TW)

( * ) Notice: Subject to any disclaimer, the term of this patent is extended or adjusted under 35 U.S.C. 154(b) by 333 days.

(21) Appl. No.: 10/266,001

(22) Filed: Oct. 7, 2002

(65) Prior Publication Data

US 2004/0065337 A1 Apr. 8, 2004

(51) Int. Cl.[7] ..... A46B 7/04

(52) U.S. Cl. ..... 15/176.3; 15/194; 119/615; 119/633

(58) Field of Search ..... 15/173.1–176.4, 15/194, 202; 119/611–616, 625–633, 664; 132/106–110

(56) References Cited

U.S. PATENT DOCUMENTS 248,817 A * 10/1881 Weaver ..... 119/612
1,818,495 A * 8/1931 Midgley ..... 119/632
1,851,859 A * 3/1932 Marshall ..... 132/110
3,167,799 A * 2/1965 McKinley ..... 15/176.4
6,006,395 A * 12/1999 Tiramani et al. ..... 15/176.1
6,141,817 A * 11/2000 Dawson ..... 15/167.1
6,260,228 B1 * 7/2001 Arroyo-Youngblood ..... 15/187

* cited by examiner

*Primary Examiner*—Kevin Shaver
*Assistant Examiner*—Stephanie L. Willatt
(74) *Attorney, Agent, or Firm*—Cowan, Liebowitz & Latman, P.C.; Eugene L. Flanagan, III

(57) ABSTRACT

A brush includes a handgrip defining a retaining recess, a cap disposed frontwardly of the handgrip and defining an insertion recess, and a felt-mounting member extending between the cap and the handgrip, and having a rear end section received in the retaining recess of the handgrip. A felt sheet is disposed on the felt-mounting member, and has a front end snugly inserted into the insertion recess of the cap, and a rear end section received in the retaining recess in the handgrip. A clamp unit includes upper and lower clamping members that releasably clamp the rear end sections of the felt sheet and the felt-mounting member therebetween.

3 Claims, 8 Drawing Sheets

BRUSH PROVIDED WITH A REPLACEABLE FELT UNIT

BACKGROUND OF THE INVENTION

1. Field of the Invention

This invention relates to a brush, more particularly to a brush provided with a replaceable felt unit.

2. Description of the Related Art

Referring to FIG. 1, a conventional brush 10 is shown to include a handgrip 11, a supporting member 111 integrally connected to and extending frontwardly from the handgrip 11, and a bristle-mounting member 12 fixed to the supporting member 111 and having a plurality of bristles 13 projecting outwardly therefrom for conducting a combing operation.

The conventional brush 10 is disadvantageous in that the bristle-mounting member 12 cannot be detached from the supporting member 111 so as to be replaced with a new one in case the bristles 13 are broken.

SUMMARY OF THE INVENTION

The main object of this invention is to provide a brush having a replaceable felt unit so as to avoid the aforesaid disadvantage resulting from the use of the conventional brush.

Accordingly, a brush of the present invention includes: a handgrip having a front end that defines a retaining recess; a cap disposed frontwardly of the handgrip, and defining an insertion recess; a felt-mounting member disposed between the handgrip and the cap, and having a rear end section received in the retaining recess, a front end opposite to the rear end section, and an upper surface; and a felt unit including a felt sheet attached detachably to the upper surface of the felt-mounting member and having a front end, a rear end section opposite to the front end of the felt sheet, and an intermediate section that extends between the front end and the rear end section. The felt unit further includes a plurality of bristles secured to the intermediate section. The front ends of the felt-mounting member and the felt sheet overlapp each other, and are snugly inserted into the insertion recess of the cap. The rear end section of the felt sheet is received in the retaining recess, and overlaps the rear end section of the felt mounting member. A clamp unit is mounted on the front end of the handgrip, and includes upper and lower clamping members that releasably clamp the rear end sections of the felt sheet and the felt-mounting member therebetween so as to detachably mount the felt-mounting member and the felt sheet on the handgrip.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
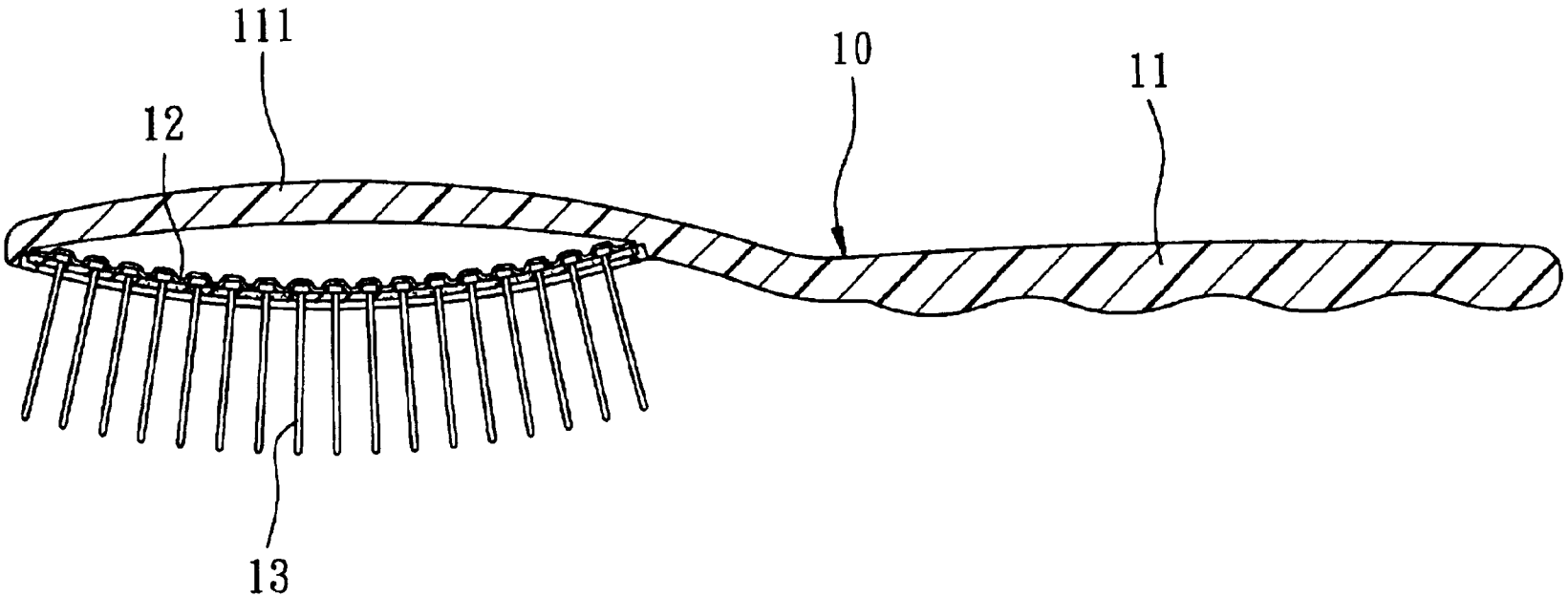
FIG. 1 PRIOR ART
FIG. 1 is a schematic sectional view of a conventional brush.
Figure 2:
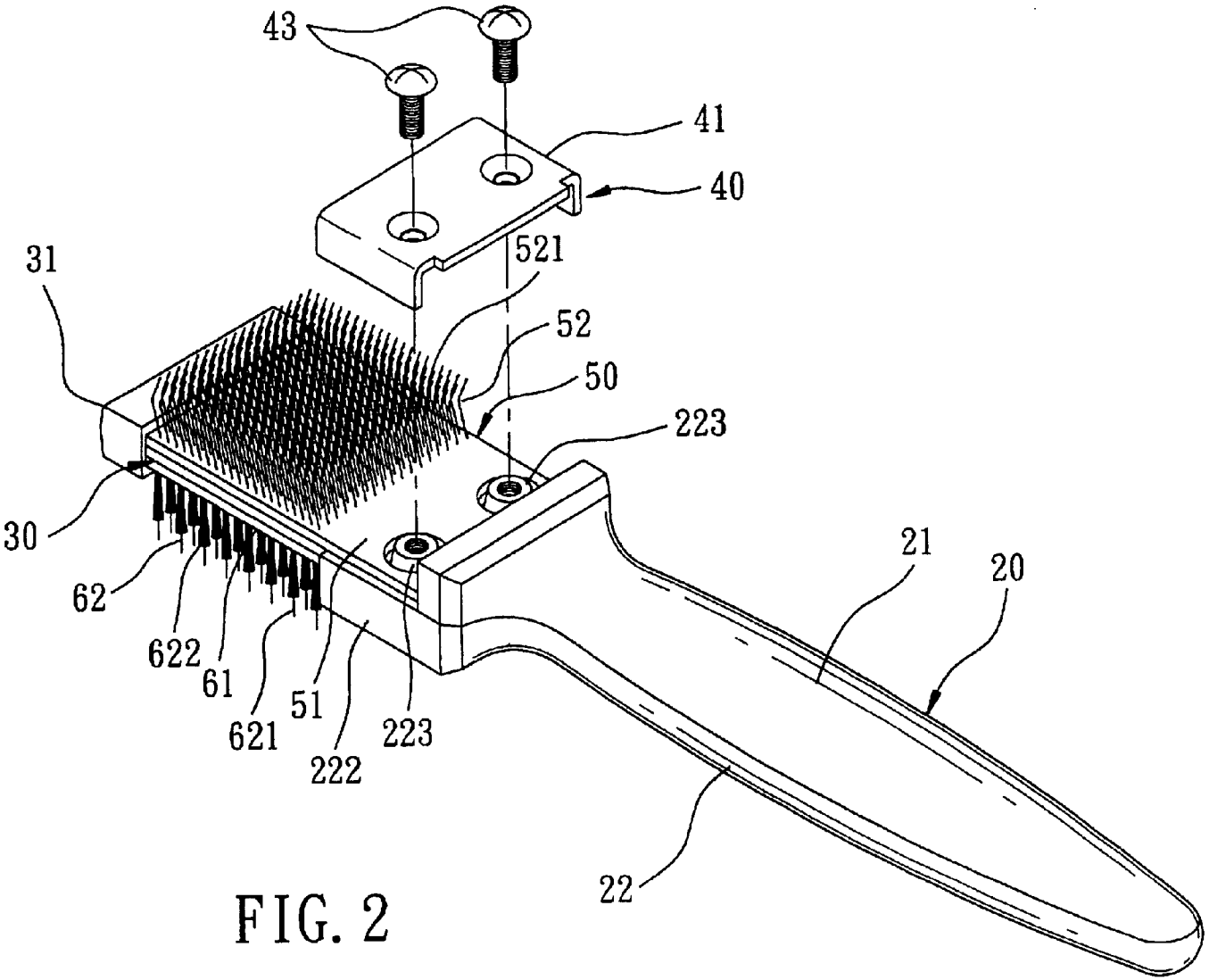
FIG. 2 is a perspective, partly exploded view of a first preferred embodiment of a brush according to the present invention.
Figure 3:
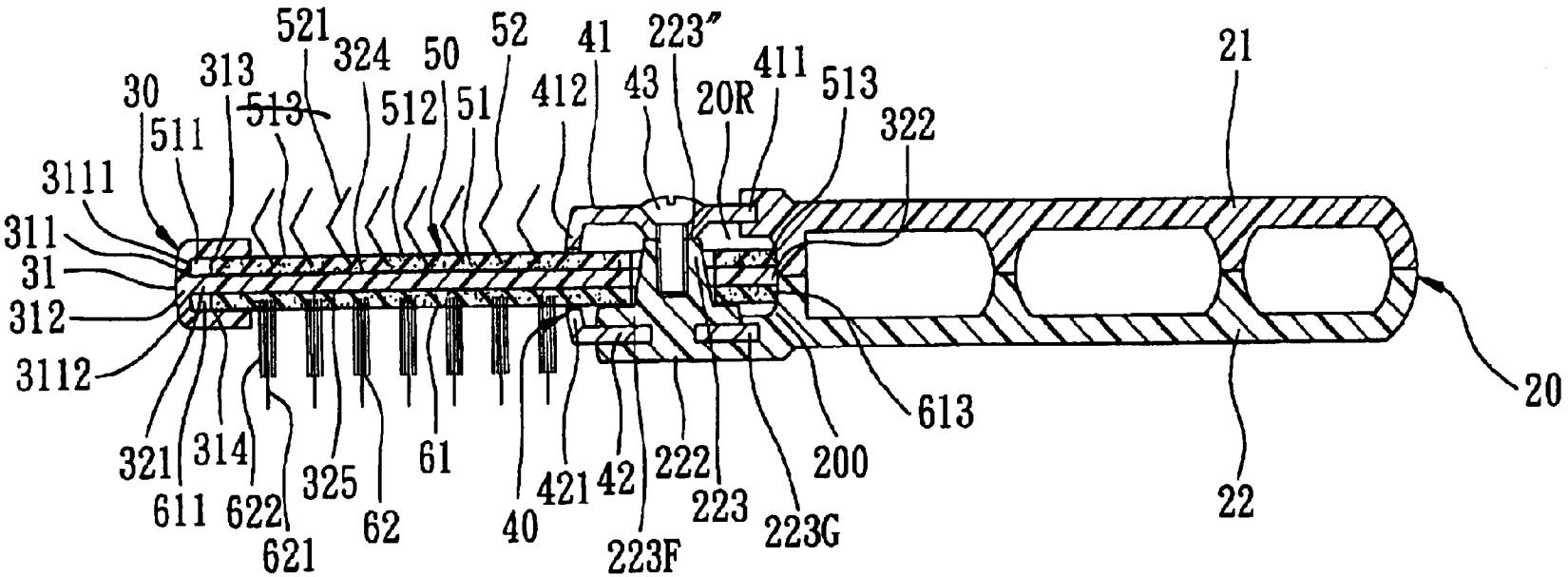
FIG. 3 is a schematic sectional side view of the first preferred embodiment, illustrating a state prior to a combing operation.

Referring to FIGS. 2 to 5, the first preferred embodiment of a brush according to the present invention is shown to include a handgrip 20, a cap 31, a felt-mounting member 30, a felt unit 50, and a clamp unit 40.

As illustrated, the handgrip 20 includes upper and lower halves 21, 22, and has a front end that defines a retaining recess 20R.

The cap 31 is disposed frontwardly of the handgrip 20, and defines an insertion recess 311 opening toward the handgrip 20.

The felt-mounting member 30 is disposed between the handgrip 20 and the cap 31, and has a rear end section 322 received in the retaining recess 20R of the handgrip 20, a front end 321 opposite to the rear end section 322, and upper and lower surfaces 324, 325.

The felt unit 50 includes an upper felt sheet 51 attached detachably to the upper surface 324 of the felt-mounting member 30 and having a front end 511, a rear end section 513 opposite to the front end 511 of the upper felt sheet 51, and an intermediate section 512 that extends between the front end 511 and the rear end section 513. A plurality of bristles 52 are secured to the intermediate section 512. Preferably, each unit of the bristles 52 is in the form of a stiff prickle 521. The front ends 321, 511 of the felt-mounting member 30 and the upper felt sheet 51 overlap each other, and are snugly inserted into the insertion recess 311. The rear end section 513 of the upper felt sheet 51 is received in the retaining recess 20R, and overlaps the rear end section 322 of the felt-mounting member 30.

The clamp unit 40 is mounted on the front end 211, 221 of the handgrip 20, and includes upper and lower clamping members 41, 42 that releasably clamp the rear end sections 513, 322 of the upper felt sheet 51 and the felt-mounting member 30 therebetween so as to detachably mount the felt-mounting member 30 and the upper felt sheet 51 on the handgrip 20.

Figure 4:
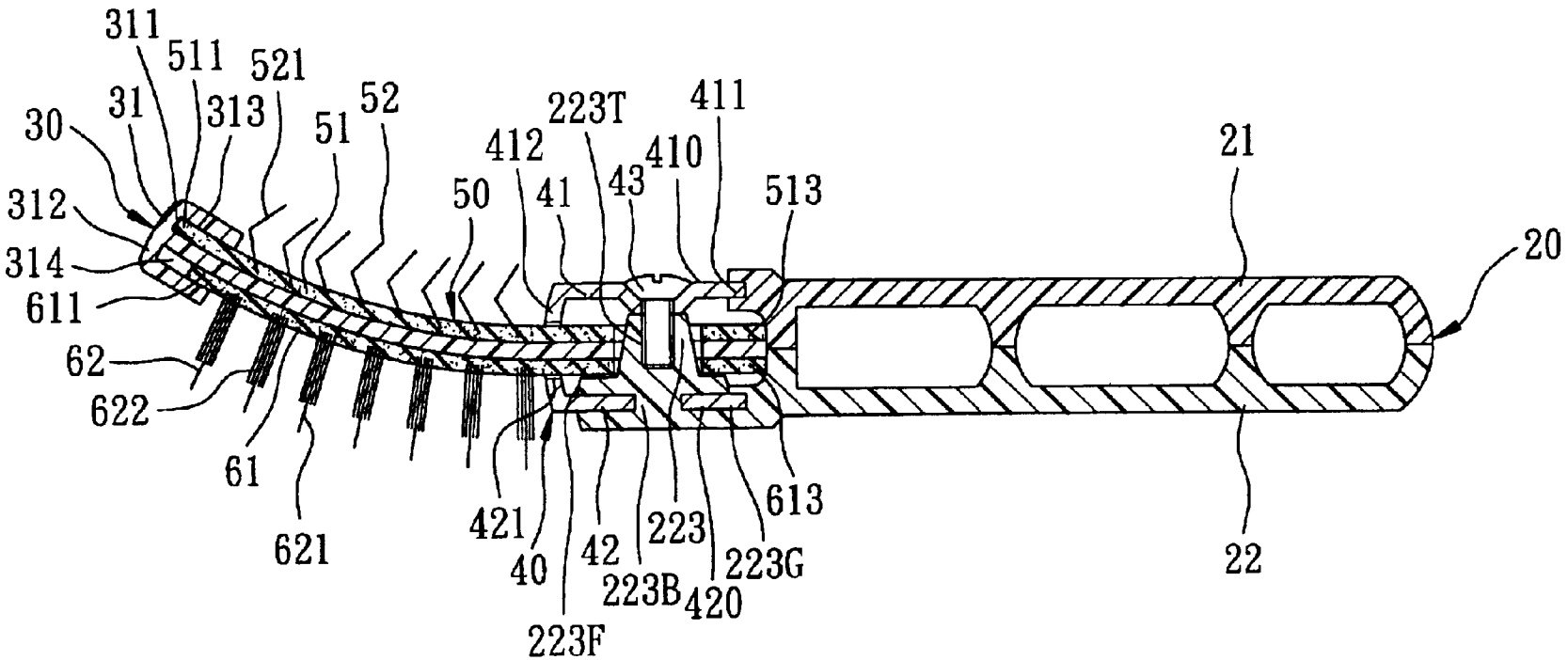
FIG. 4 is a schematic sectional side view of the first preferred embodiment, illustrating how a lower felt sheet reacts during a combing operating.
Figure 5:
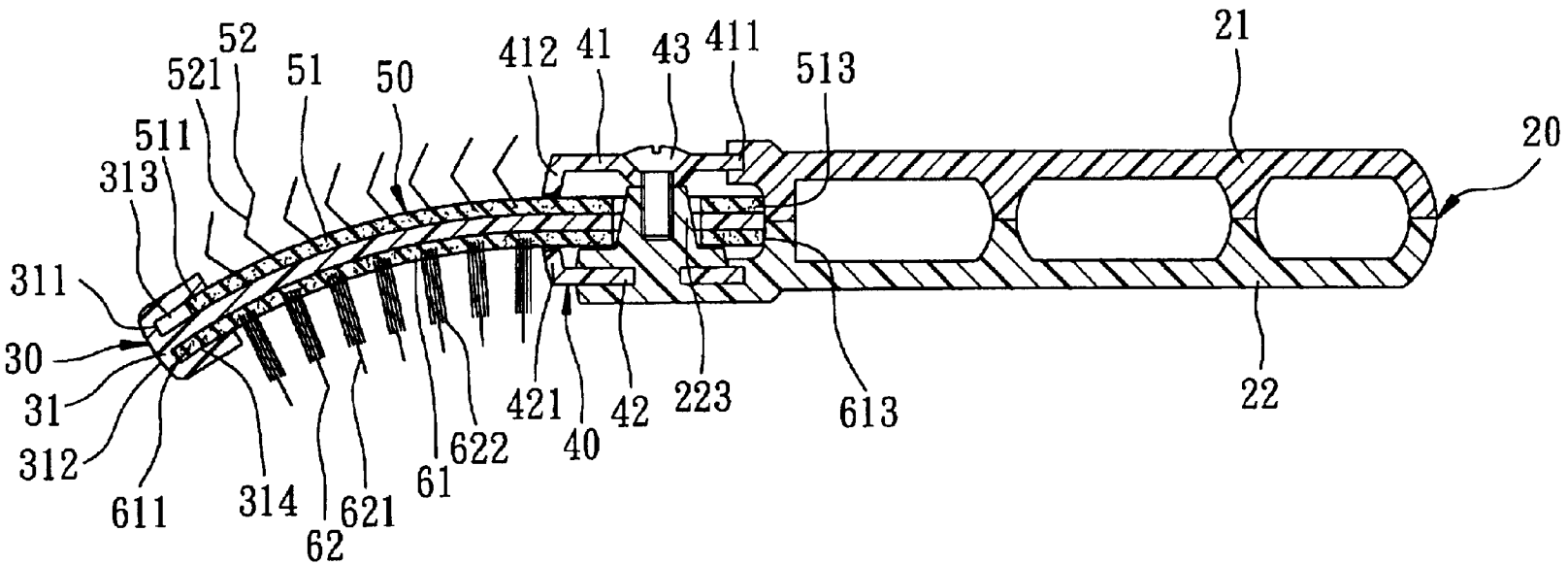
FIG. 5 is a schematic sectional side view of the first preferred embodiment, illustrating how an upper felt sheet reacts during a combing operating.
Figure 6:
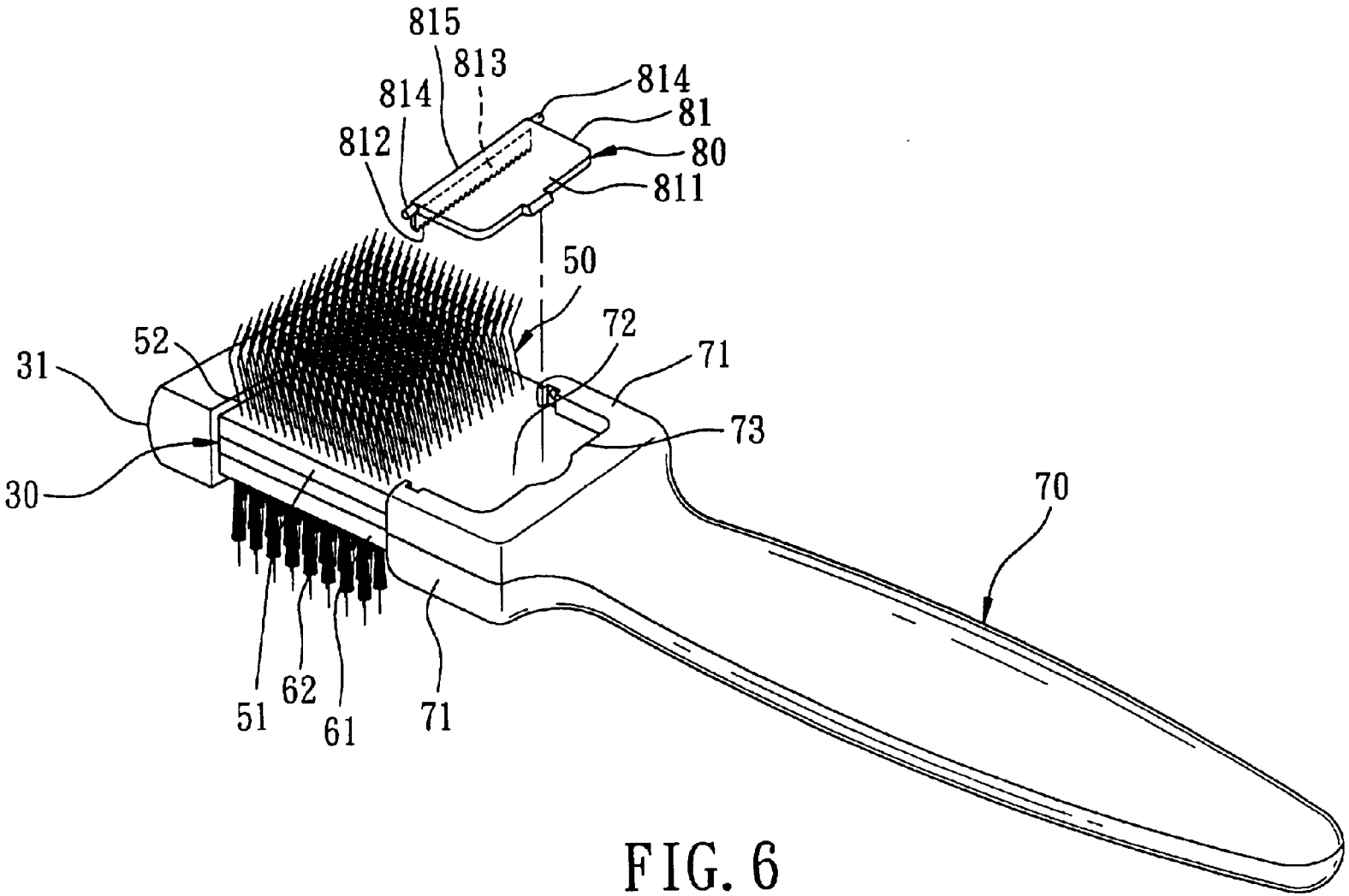
FIG. 6 is a perspective, partly exploded view of a second preferred embodiment of a brush according to the present invention.
Figure 7:
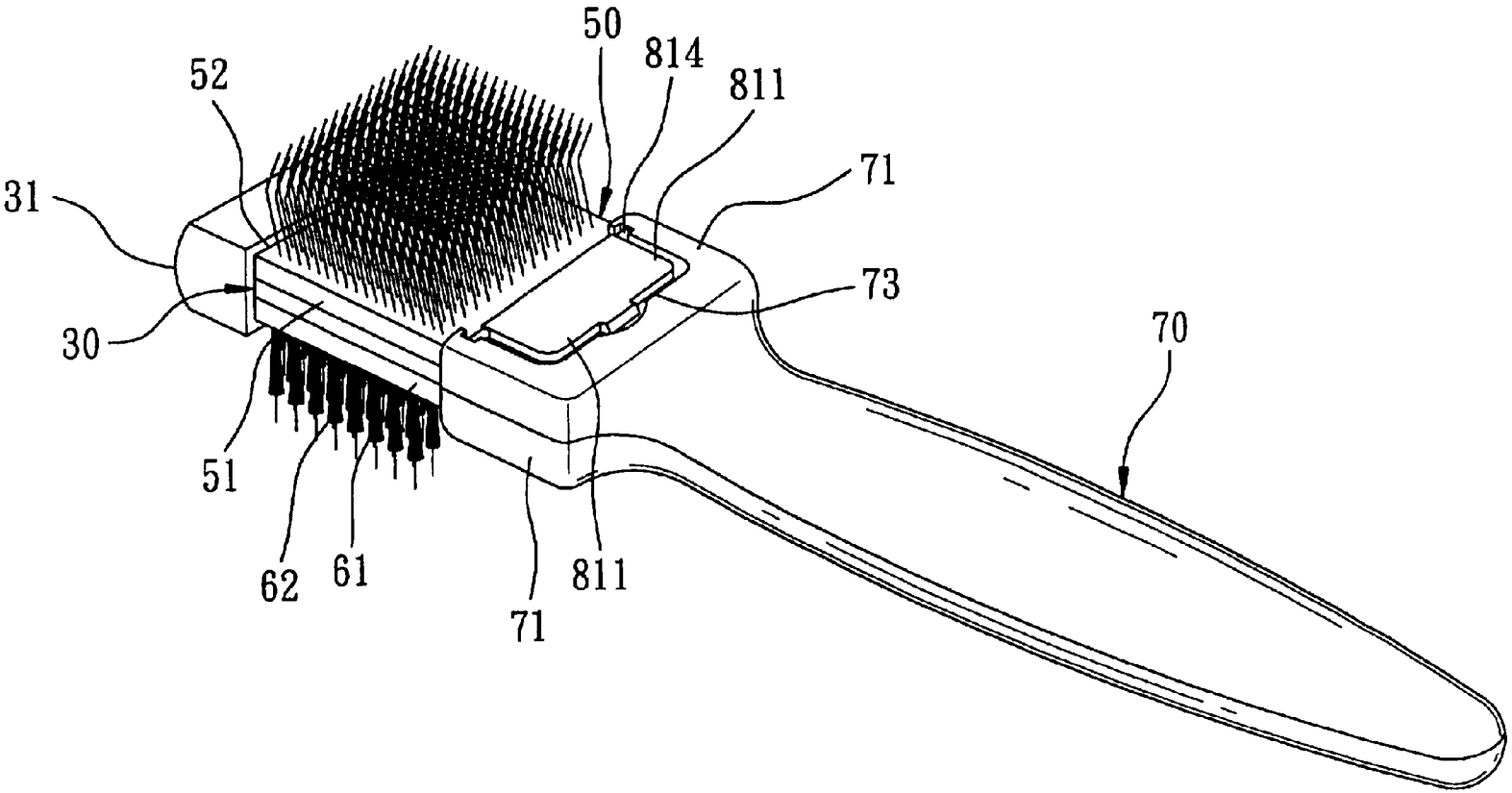
FIG. 7 is an assembled perspective view of the second preferred embodiment.
Figure 8:
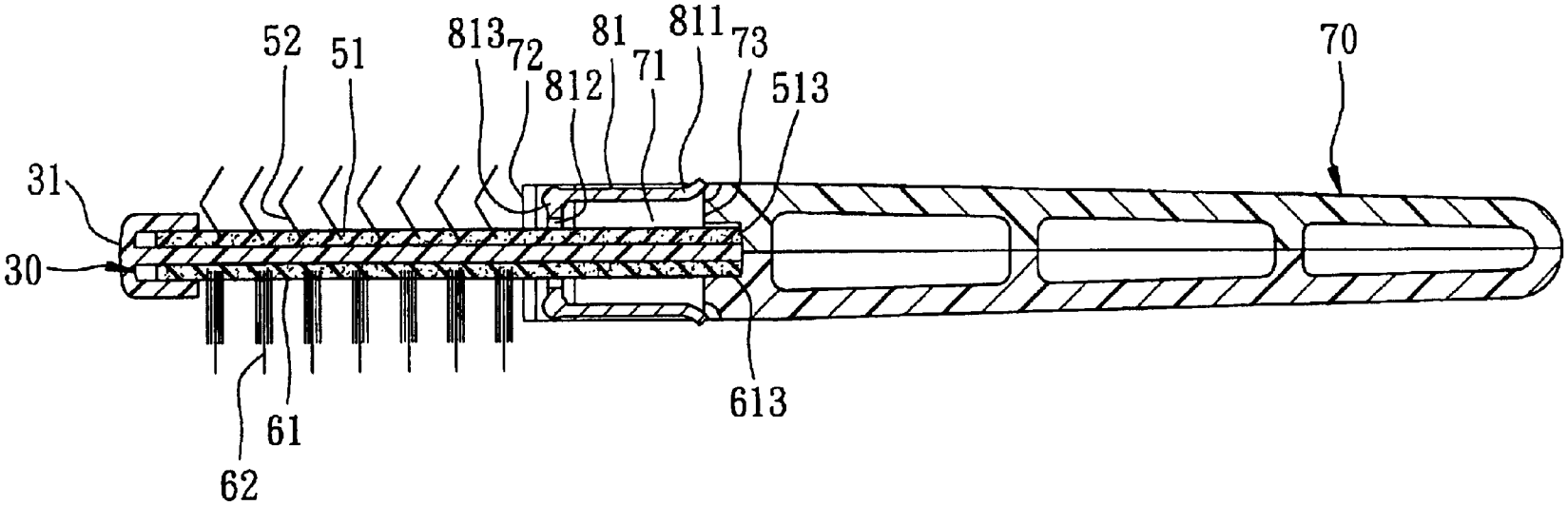
FIG. 8 is a schematic sectional side view of the second preferred embodiment, illustrating a state prior to a combing operation.

In the first preferred embodiment, the cap 31 includes two parallel arms 313, 314 and a bridging portion 312 that interconnects the arms 313, 314. The front end 321 of the felt-mounting member 30 is integrally connected to the bridging portion 312 of the cap 31 to divide the insertion recess 311 into upper and lower insertion recesses 3111, 3112. The front end 511 of the upper felt sheet 51 is snugly inserted into the upper insertion recess 3111. The felt unit 50 further includes a lower felt sheet 61 that is attached detachably to the lower surface 325 of the felt-mounting member 30, and that has a front end 611 snugly inserted into the lower insertion recess 3112, and a rear end sectin 613 that overlaps the rear end section 322 of the felt-mounting member 30 and that is received in the retaining recess 20R of the handgrip 20. A plurality of bundles of bristles 62 are attached securely to an intermediate portion 612 of the lower felt sheet 61. Preferably, each bundle of the bristles 62 includes a single strand of long hair 621 and several strands of flexible short hairs 622 around the long hair 621. The retaining recess 20R of the handgrip 20 is confined by a generally L-shaped wall 200 having a lateral wall portion 222 that extends in a direction substantially parallel to the felt-mounting member 30. A clamp-mounting seat includes a post 223 that extends from the lateral wall portion 222 into the retaining recess 20R in a transverse direction relative to the felt-mounting member 30, and a flange 223F that extends transversely from the post 223 and that cooperates with the lateral wall portion 222 to define a retaining groove 223G therebetween. The post 223 has a top part 223T formed with an inner thread 223" above the retaining groove 223G, and a bottom part 223B extending between the flange 223F and the lateral wall portion 222. The rear end sections 513, 613, 322 of the upper and lower felt sheets 51, 61 and the felt-mounting member 30 are sleeved on the top part 223T of the post 223 for retention thereon. The lower clamping member 42 preferably includes a lateral plate portion 420 sleeved on the bottom part 223B of the post 223 and securely retained in the retaining groove 223G, and a bent plate portion 421 that bends upwardly from the lateral plate portion 420 to abut against the lower felt sheet 61. The upper clamping member 41 preferably includes a lateral plate portion 410 that is inserted into a groove 411 in the handgrip 20 and that is disposed above the top part 223T of the post 223 parallel to the lateral plate portion 420 of the lower clamping member 42, and a bent plate portion 412 that bends downwardly from the lateral plate portion 410 of the upper clamping member 41 to abut against the upper felt sheet 51. A fastener bolt 43 extends through the lateral plate portion 410 of the upper clamping member 41, and engages threadedly the inner thread 223" in the top part 223T of the post 223 so as to push the bent plate portion 412 of the upper clamping member 41 toward the bent plate portion 421 of the lower clamping member 42, thereby clamping the upper and lower felt sheets 51, 61 and the felt-mounting member 30 between the upper and lower clamping members 41, 42. The felt-mounting member 30 is flexible such that the felt-mounting member 30 bends relative to the handgrip 20, as best shown in FIGS. 4 and 5, when the brush is used to conduct a combing operation, such as brushing fur of a pet. Referring to FIGS. 6 and 7, a second preferred embodiment of a brush of the present invention is shown to have a structure similar to that of the previous embodiment. The main difference resides in the clamping unit 80. As shown, the felt-mounting member 30 having two opposite sides. The retaining recess 72 of the handgrip 70 is confined by a U-shaped wall 73 having two opposite wall portions 71 respectively sandwiching the opposite sides of the felt-mounting member 30 therebetween. Each of the upper and lower clamping members 81 includes a serrated plate 813 disposed adjacent to a respective one of the upper and lower felt sheets 51, 61, and having a serrated side 812 and a pivot side 815 that is opposite to the serrated side 812 and that has two opposite pivot ends 814 respectively pivoted to the opposite wall portions 71 of the U-shaped wall 73. Each of the upper and lower clamping members 81 further includes an actuating plate 811 that is perpendicular to and that extends from the pivot side 815 of the serrated plate 813 and that is operable to rotate the serrated plate 813 relative to the U-shaped wall 73 between a clamping position, in which the serrated side 812 of the serrated plate 813 is substantially perpendicular to and presses the rear end section of the respective one of the upper and lower felt sheets 51, 61 against the rear end section of the felt-mounting member 30, as best shown in FIG. 8, so as to clamp the upper and lower felt sheets 51, 61 and the felt-mounting member 30, and a non-clamping position, in which, the serrated side 812 of the serrated plate 813 is moved away from the rear end section of the respective one of the upper and lower felt sheets 51, 61 so as to permit removal of the felt-mounting member 30 from the handgrip 70 and removal of the upper and lower felt sheets 51, 61 from the felt-mounting member 30.

With this invention thus explained, it is apparent that numerous modifications and variations can be made without departing from the scope and spirit of this invention. It is therefore intended that this invention be limited only as indicated by the appended claims.

I claim:

1. A brush comprising:

a handgrip having a front end that defines a retaining recess;

a cap disposed frontwardly of said handgrip, and defining an insertion recess;

a felt-mounting member disposed between said handgrip and said cap, and having a rear end section received in said retaining recess, a front end opposite to said rear end section, and an upper surface;

a felt unit including an upper felt sheet attached detachably to said upper surface of said felt-mounting member, and having a front end, a rear end section opposite to said front end of said upper felt sheet, and an intermediate section that extends between said front end and said rear end section, said felt unit further including a plurality of bristles secured to said intermediate section, said front ends of said felt-mounting member and said upper felt sheet overlapping each other and being snugly inserted into said insertion recess, said rear end section of said upper felt sheet being received in said retaining recess and overlapping said rear end section of said felt-mounting member; and a clamp unit mounted on said front end of said handgrip, and including upper and lower clamping members that releasably clamp said rear end sections of said upper felt sheet and said felt-mounting member therebetween so as to detachably mount said felt-mounting member and said upper felt sheet on said handgrip.

2. The brush as defined in claim 1, wherein said felt-mounting member has a lower surface opposite to said upper surface, said felt unit further including a lower felt sheet attached detachably to said lower surface of said felt-mounting member, said lower felt sheet having a rear end section, said retaining recess being confined by a generally L-shaped wall having a lateral wall portion extending in a direction substantially parallel to said felt-mounting member, said brush further comprising a clamp-mounting seat including a post extending from said lateral wall portion into said retaining recess in a transverse direction relative to said felt-mounting member, and a flange extending transversely from said post and cooperating with said lateral wall portion to define a retaining groove, said post having a top part formed with an inner thread above said retaining groove, and a bottom part extending between said flange and said lateral wall portion, said rear end sections of said upper and lower felt sheets and said felt-mounting member being sleeved on said top part of said post, said lower clamping member including a lateral plate portion sleeved on said bottom part of said post and securely retained in said retaining groove, and a bent plate portion bending upwardly from said lateral plate portion to abut against said lower felt sheet, said upper clamping member including a lateral plate portion disposed above said top part of said post and parallel to said lateral plate portion of said lower clamping member, and a bent plate portion bending downwardly from said lateral plate portion of said upper clamping member to abut against said upper felt sheet, said clamping unit further including a fastener bolt extending through said lateral plate portion of said upper clamping member and engaging threadedly said inner thread in said top part of said post so as to push said bent plate portion of said upper clamping member toward said bent plate portion of said lower clamping member, thereby clamping said upper and lower felt sheets and said felt-mounting member between said upper and lower clamping members.

3. The brush as defined in claim 1, wherein said felt-mounting member has a lower surface opposite to said upper surface, said felt unit further including a lower felt sheet attached detachably to said lower surface of said felt-mounting member, said lower felt sheet having a rear end section, said felt-mounting member further having two opposite sides, said retaining recess being confined by a U-shaped wall having two opposite wall portions respectively sandwiching said opposite sides of said felt-mounting member therebetween, each of said upper and lower clamping members including a serrated plate disposed adjacent to a respective one of said upper and lower felt sheets, and having a serrated side and a pivot side that is opposite to said serrated side and that has two opposite pivot ends respectively pivoted to said opposite wall portions of said U-shaped wall, each of said upper and lower clamping members further including an actuating plate that is perpendicular to and that extends from said pivot side of said serrated plate and that is operable to rotate said serrated plate relative to said U-shaped wall between a clamping position, in which said serrated side of said serrated plate is substantially perpendicular to and presses said rear end section of the respective one of said upper and lower felt sheets against said rear end section of said felt-mounting member so as to clamp said upper and lower felt sheets and said felt-mounting member, and a non-clamping position, in which said serrated side of said serrated plate is moved away from said rear end section of the respective one of said upper and lower felt sheets so as to permit removal of said felt-mounting member from said handgrip and removal of said upper and lower felt sheets from said felt-mounting member.

* * * * *